US007543728B2

(12) United States Patent
Spasov et al.

(10) Patent No.: US 7,543,728 B2
(45) Date of Patent: Jun. 9, 2009

(54) HAND-HELD DRIVE-IN TOOL

(75) Inventors: Robert Spasov, Schaan (LI); Matthias Blessing, Frastanz (AT); Hans Gschwend, Buchs (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/008,305

(22) Filed: Jan. 9, 2008

(65) Prior Publication Data

US 2008/0173688 A1 Jul. 24, 2008

(30) Foreign Application Priority Data

Jan. 11, 2007 (DE) ..... 10 2007 000 007

(51) Int. Cl.
*B25C 5/06* (2006.01)

(52) U.S. Cl. ..... 227/132; 227/131; 173/202

(58) Field of Classification Search ..... 227/2, 227/8, 131, 132, 133; 173/205, 117, 202, 173/203

See application file for complete search history.

(56) References Cited

U.S. PATENT DOCUMENTS 1,767,485 A * 6/1930 Shallenberger ..... 227/147
1,845,617 A * 2/1932 Metcalf ..... 227/96
2,575,455 A * 11/1951 Lang ..... 227/138
3,305,156 A * 2/1967 Khan ..... 227/132
3,589,588 A * 6/1971 Vasku ..... 227/132
3,847,322 A 11/1974 Smith
4,121,745 A * 10/1978 Smith et al. ..... 227/8
4,724,992 A * 2/1988 Ohmori ..... 227/146
4,807,793 A * 2/1989 Ghibely ..... 227/131
4,811,885 A * 3/1989 Lai ..... 227/131
4,834,278 A * 5/1989 Lin ..... 227/7
5,118,023 A * 6/1992 Fushiya et al. ..... 227/8
5,503,319 A * 4/1996 Lai ..... 227/132
5,511,715 A * 4/1996 Crutcher et al. ..... 227/131
5,720,423 A * 2/1998 Kondo et al. ..... 227/130
5,927,585 A * 7/1999 Moorman et al. ..... 227/132
5,941,441 A * 8/1999 Ilagan ..... 227/131
6,604,666 B1 * 8/2003 Pedicini et al. ..... 227/131
6,769,593 B2 * 8/2004 Pedicini et al. ..... 227/131
6,899,260 B2 * 5/2005 Sun ..... 227/132
6,997,367 B2 * 2/2006 Hu ..... 227/132
7,121,443 B2 * 10/2006 Sun et al. ..... 227/131
7,322,502 B1 * 1/2008 Sun ..... 227/8
7,325,711 B2 * 2/2008 Schiestl et al. ..... 227/131

* cited by examiner

*Primary Examiner*—Scott A. Smith
(74) *Attorney, Agent, or Firm*—Abelman, Frayne & Schwab

(57) ABSTRACT

A hand-held drive-in tool for driving fastening elements in includes a drive-in ram (13) displaceably supported in the guide (12), a spring member (31) for displacing the drive-in ram (13), a device (70) for preloading the driving spring member (31) and a locking device (50) having a locking position (54) in which the locking device (50) retains the driving spring member (31) in its preloaded position (22) and includes an annular member (49) pivotally arranged on the locking device (50) and rollable off the locking stop (53) provided on the drive-in ram (13).

4 Claims, 3 Drawing Sheets

HAND-HELD DRIVE-IN TOOL

BACKGROUND OF THE INVENTION

1. Field of the Invention

The present invention relates to a hand-held drive-in tool for driving fastening elements in a constructional component or a workpiece and including a drive-in ram displaceably supported in a guide for driving fastening elements in the constructional component or the workpiece, a drive for driving the drive-in ram and having a driving spring member for displacing the drive-in ram, a device for preloading the driving spring member, a locking device having a locking position in which the locking device retains the driving spring member in its preloaded position and including locking means.

2. Description of the Prior Art

In a drive-in tool described above, the driving spring member is formed as a mechanical spring.

The advantage of drive-in tools of the type described above consists in using a low-cost mechanical driving spring member, which permits to economically manufacture this type of drive-in tools. Because a preloading process can last only from ten to several hundred milliseconds, in particular when very strong driving springs are used, it is advantageous when the preloading process is already completely carried out before actuation of the actuation switch of the drive-in tool. It is further necessary that the driving spring is fixed in its preloaded position before actuation of the drive-in process by a locking device, directly or indirectly, e.g., via another element such as the drive-in ram.

A drive-in tool of the type described above is disclosed in U.S. Pat. No. 3,847,322. In the disclosed drive-in tool, a drive-in ram is preloaded against a driving spring member by a motor-driven preloading mechanism. A locking device retains the drive-in ram and the driving spring member in the preloaded position. To this end, the locking device has locking means that lockingly engages a locking surface on the drive-in ram. The locking device is released by an actuation switch, whereby the locking device is lifted off its locking position by a motor-driven mechanism and is displaced in a release position. In the release position of the locking device, the drive-in ram is displaced in the setting direction by the biasing force of the driving spring member for driving a fastening element in a workpiece.

The drawback of the known drive-in tool consists in that the sliding friction between the locking means and the locking surface is relatively high, so that lifting of the locking means off is rather, slow-going. Furthermore, loss of the material due to the sliding friction under a surface pressure is rather high.

Accordingly, an object of the present invention is a drive-in tool in which the above-discussed drawbacks a known drive-in tool is eliminated.

SUMMARY OF THE INVENTION

This and other objects of the present invention, which will become apparent hereinafter, are achieved by providing a drive-in tool in which the drive-in ram is provided with a locking stop, and the locking device includes an annular member pivotally arranged on the locking device and rollable off the locking stop.

With the rollable-off annular member, the frictional resistance is noticeably reduced upon release of the annular member that serves as a locking member, because instead of the sliding friction, a much smaller rolling friction takes place as the annular member rolls off the locking stop. The release of the locking member is easy-going and requires, therefore, much less energy. Further, the wear of the cooperating parts is noticeably reduced.

Advantageously, the locking device includes a support pivotable about a pivot axis and the annular member is supported on a rotational axis provided on the support. The rotational axis of the annular member extends parallel to the pivot axis of the support.

Thereby, all frictional losses except the rolling friction losses are prevented.

Advantageously, the annular member is formed as a roller bearing, which minimizes the rolling friction. The roller bearings are cost-effective as standard parts are used. Thereby, no high additional costs are involved.

It is further advantageous when a contact of the annular member with the locking stop is spaced, in a direction opposite a direction of a locking pivotal movement of the support from a point of the locking stop closest to the pivot axis of the support.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
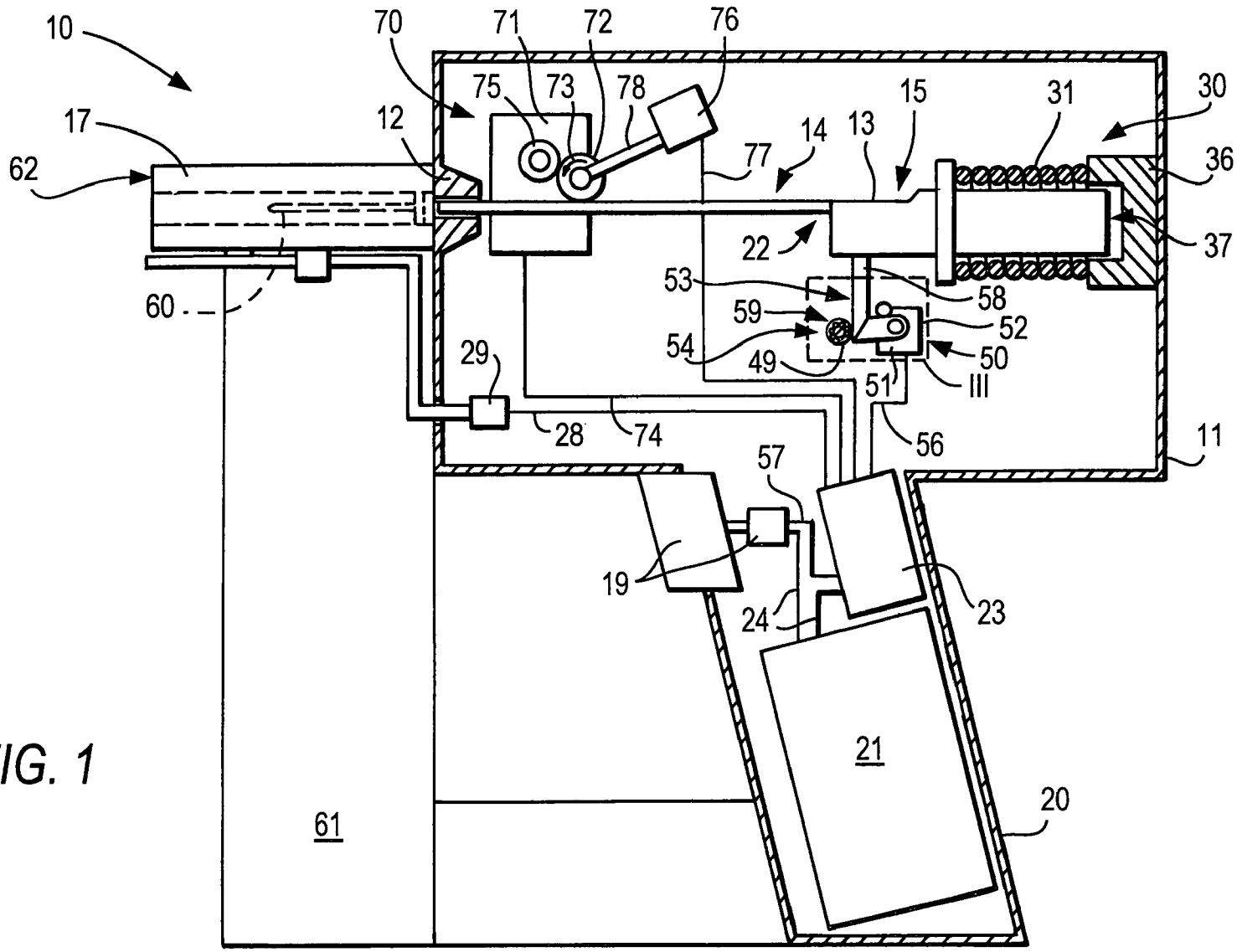
FIG. 1 a longitudinal cross-sectional view of a drive-in tool according to the present invention.

A drive-in tool 10 according to the present invention, which is shown in FIG. 1, includes a housing 11 and a drive generally designated with a reference numeral 30 and arranged in the housing 11. The drive 30 drives a drive-in ram 13 displaceable in a guide 12 likewise located in the housing 11. The drive-in ram 13 has a drive-in section 14 for driving a fastening element 60 and a head section 15.

A bolt guide 17, which is arranged coaxially with the guide 12, adjoins the guide 12 at the end of the guide 12 facing in the drive-in direction 27. A magazine 61, in which fastening elements 60 are stored, projects sidewise from the bolt guide 17.

The drive 30 includes a driving spring member 31 which is indirectly supported against the housing 11 at a support location 36 at one of its ends and which engages the head section 15 of the drive-in ram 13 with another of its end. The driving spring member can be formed, e.g., as a composite spring or as a steel spring and is formed as e.g., a helical spring.

In its loaded condition 22, which is shown in FIG. 1, the drive-in ram 13 is resiliently preloaded against the driving spring member 31 and has its head section 15 inserted in a cylindrical guide space 37 defined by the driving spring member 31 and the support location 36 for the driving spring member 31. The possibility to displace the head section 15 in the guide space 37 within the means defining the support location and, in particular, within the driving spring member 31 permits to obtain advantageously a compact construction.

Figure 2:
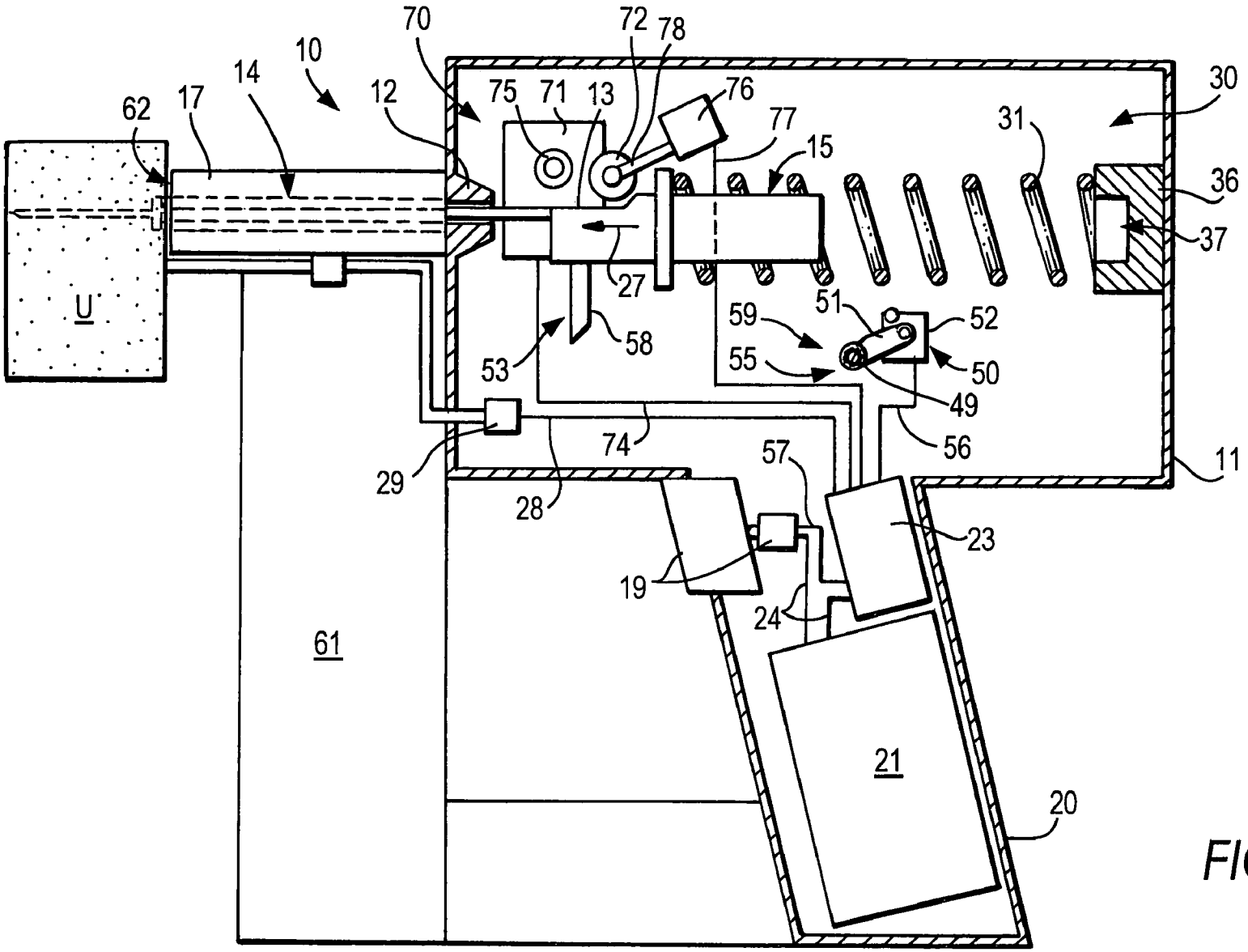
FIG. 2 a view similar to that of FIG. 1, with the drive-in tool in an actuated condition.
Figure 3:
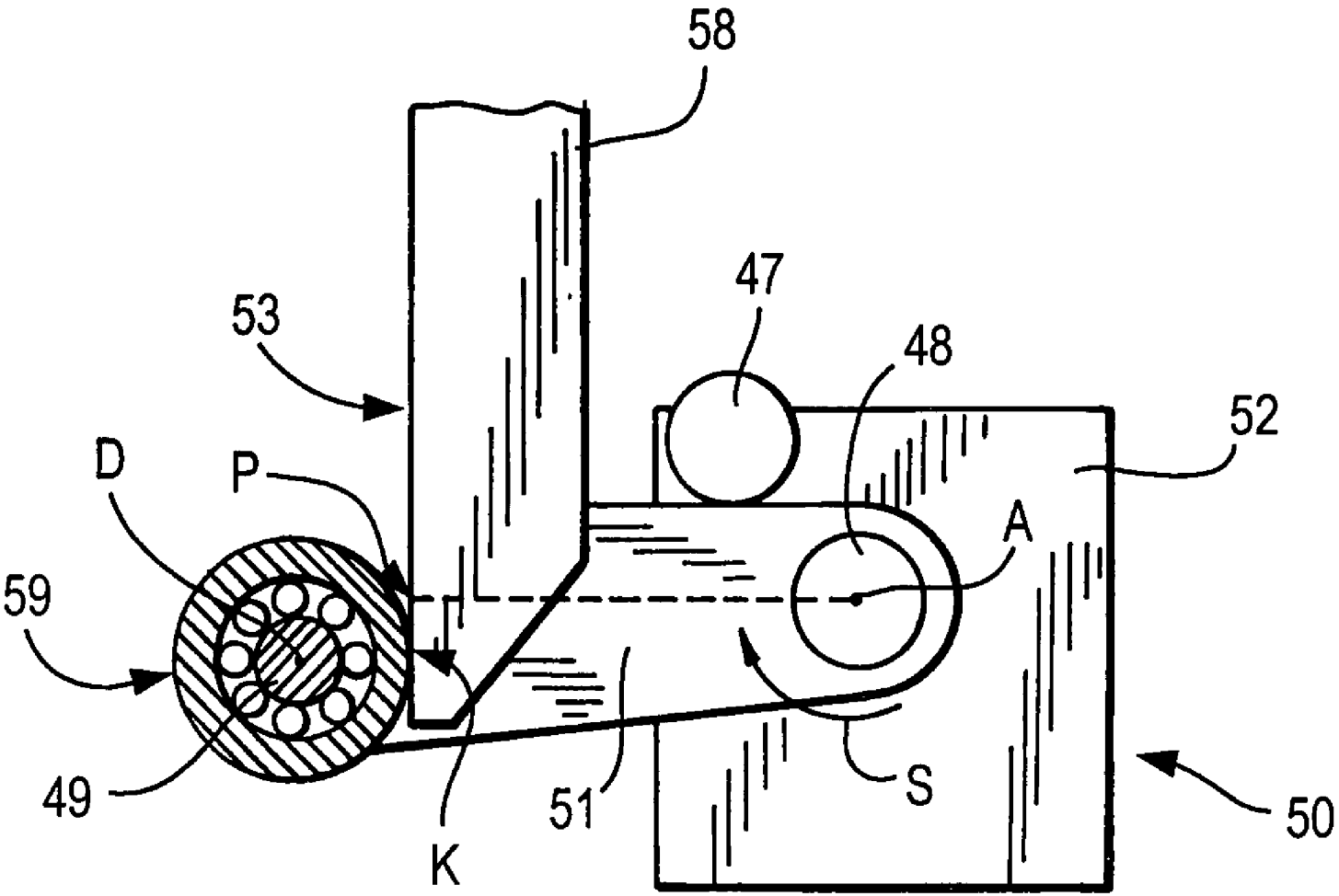
FIG. 3 a detail of the drive-in tool showing the portion III in FIG. 1.

In the loaded position 22, the drive-in ram 13 is retained by a locking device generally designated with a reference numeral 50. The locking device 50 has a locking member in form of annular member 59 that is rotatably supported on a support 51. In a locking position 54 (see FIG. 1), the annular member 59 engages with a locking surface 59 a locking stop 53 formed on a projection 58 of the drive-in ram 13, retaining the drive-in ram 13 against action of the biasing force of the driving spring member 31. The locking surface 59 circumferentially surrounds the annular member 49 that is formed, e.g., as a roller bearing. With the use of a roller bearing as the annular member 49, the rolling friction can be reduced to a minimum. The support 51 is formed as a pivot arm supported on a shaft 48 of a servo motor 52 which displaces the locking device 50 in its release position 55 shown in FIG. 2, as it would be described further below. The shaft 48 defines a pivot axis A around which the support 51 pivots. The rotational axis D of the annular member 49 extends parallel to the pivot axis A of the support 51 in order to prevent any other friction losses except the occurring roller friction. As shown in FIG. 3, the contact K of the locking surface 59 or of the annular member 49 with the locking stop 53 is spaced from a point P of the locking stop 53 closest to the pivot axis A, with respect to the closing direction S (the arrow) of the support 51, whereby the support 51, together with the annular member 49, forms self-closing locking means.

The servo motor 52 is connected by a first electrical conductor 56 with the tool control unit 23 that controls the operation of the servo motor 52.

The drive-in tool 10 has a handle 20 on which an actuation switch 19 for actuating a drive-in process with the drive-in tool is arranged. Further, a receptacle 18 for receiving a network-dependent power source 21 is provided in the handle 20. The power source 21 supplies the drive-in tool 10 with the electrical energy. In the disclosed embodiment, the power source 21 has at least one accumulator. The power source 21 is connected with the control unit 23 and the actuation switch 19 by respective supply conductors 24. A switching conductor 57 connects the control unit 23 with the actuation switch 19.

On the muzzle 62 of the drive-in tool 10, there is provided a switch 29 connected with the control unit 23 by a switching conductor 28. The switch 29 communicates an electrical signal to the control unit 23 as soon as the drive-in tool 10 is pressed again the workpiece U, as shown in FIG. 2. Thereby, the switch 29 insures that the control unit 23 initiates a setting process with the drive-in tool 10 only then when the drive-in tool 10 is properly pressed against the workpiece U.

The drive-in tool 10 further has a tensioning or preloading device, which is generally designated, with a reference numeral 70. The preloading device 70 has a motor 71 for driving a drive roller 72. A second control conductor 74 electrically connects the motor 71 with the control unit 23 that actuates the motor 71 when, e.g., the drive-in ram 13 is located in its end position in the drive-in direction 27 or when the drive-in tool 10 is lifted off the workpiece U. The motor 71 has an output member 75 such as a driven gear which is connectable with the drive roller 72. The drive roller 72 is supported rotatably on a longitudinally adjustable control arm 78 of an adjustment element 76 formed as a solenoid. The adjustment element 76 is connected with the control unit 23 by an adjustment conductor 77. During an operation, the drive roller 72 is connected with the output member 75 that rotates the drive roller 72 in the direction of arrow 73 shown with dash lines.

When the drive-in tool 10 is actuated by a main switch, not shown, the control unit 23 firstly ascertains that the drive-in ram 13 is located in its preloaded position 22 shown in FIG. 1. If this is not the case, then the adjustment element 76 displaces the drive roller 72 into engagement with the output member 75 driven by the motor 71. Simultaneously, the drive roller 72 engages the drive-in ram 13 which is displaceable by the drive roller 72 rotatable in the direction of arrow 73, in the direction of the drive 30. This preloads the driving spring member 31 of the drive 30. When the drive-in ram 13 and the driving spring member 31 reach their preloaded or initial position 22, the annular member 49 engages with its locking surface 59 the locking stop 53 of the drive-in ram 13, retaining the drive-in ram in the preloaded position 22. To this end, the support 51, together with the annular member 49, can be spring-biased in the direction of the drive-in ram 13 or into a position in which it engages a stop 47.

Upon engagement of the annular member 49 with the locking stop 53, the motor 71 can be turned off by the control unit 23 and the adjustment element 76, which is also controlled by the control unit 23, displaces the drive roller 72 from the position in which it engages the output element 75 and the drive-in ram 13, into its disengaged position.

When the drive-in tool 10 is pressed against a workpiece U, as shown in FIG. 2, firstly, the switch 29 sets the control unit 23 into a setting-ready condition. Upon actuation of the actuation switch 19 by a user, the control unit 23 displaces the locking device 50 in its release position 55 in which the support 51, together with the annular member 49, is lifted off the drive-in ram 13. At that, the annular member 49 rolls with its locking surface 59 along the locking stop 53 on the projection 58 downwardly with a very small rolling resistance.

The locking surface 59 must not be continuous but also can be discontinuous, e.g., be formed as a structural or profiled surface.

Upon lifting of the locking device 50 off, the driving spring member 31 of the drive 30 displaces the drive-in ram 13 in the drive-in direction 27, whereby the fastening element 60 is driven in the workpiece U.

For returning the drive-in ram 13 and for preloading the driving spring member 31, at the end of the drive-in process, the preloading device 70 is actuated by the control unit 23, when the drive-in tool 10 is lifted again off the workpiece U. To this end, the switch 29 communicates an appropriate signal to the control unit 23. The preloading device 70 displaces the drive-in ram 13 in the above described manner against the driving spring member 31 of the drive 30, preloading the driving spring member 31. The drive-in ram 13 displaces the driving spring member 31 until the support 51, together with the annular member 49 is displaced again into its locking position 54 on the locking stop 53 on the drive-in ram 13.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving in fastening elements, comprising a guide (12); a drive-in ram (13) displaceably supported in the guide (12); a drive (30) for driving the drive-in ram (13) and having a driving spring member (31) for displacing the drive-in ram (13); a device (70) for preloading the driving spring member (31); and a locking device (50) having a locking position (54) in which the locking device (50) retains the driving spring member (31) in a preloaded position (22) thereof, wherein the drive-in ram (13) is provided with a locking stop (53), and the locking device (50) includes an annular member (49) pivotally arranged on the locking device (50) and rollable off the locking stop (53).

2. A hand-held drive-in tool according to claim 1, wherein the locking device (50) further includes a support (51) pivotable about a pivot axis (A), and the annular member (49) is supported on a rotational axis (D) provided on the support (51), and wherein the rotational axis (D) of the annular member (49) extends parallel to the pivot axis (A) of the support (51).

3. A hand-held drive-in tool according to claim 1, wherein the annular member (49) is formed as a roller bearing.

4. A hand-held drive-in tool according to claim 1, wherein a contact (K) of the annular member (49) with the locking stop (53) is spaced in a direction opposite a direction(s) of a locking pivotal movement of the support (51), from a point (P) of the locking stop (53) closest to a pivot axis (A) of the support (51).

* * * * *